United States Patent [19]

Brüstle et al.

[11] 4,385,416

[45] May 31, 1983

[54] ADJUSTABLE FURNITURE HINGE

[76] Inventors: Klaus Brüstle, Fellentorstr. 23, Lauterach, Austria, A-6923; Erich Röck, Küferstr. 7, Höchst, Austria, A-6973

[21] Appl. No.: 276,635

[22] Filed: Jun. 23, 1981

[30] Foreign Application Priority Data

Jul. 7, 1980 [AT] Austria ..... 3523/80

[51] Int. Cl.[3] ..... E05D 7/04

[52] U.S. Cl. ..... 16/249

[58] Field of Search ..... 16/366, 370, 237, 249, 16/379, 382

[56] References Cited

U.S. PATENT DOCUMENTS

| | | | |
|---|---|---|---|
| 4,104,762 | 8/1978 | Rock et al. | 16/237 |
| 4,156,301 | 5/1979 | Schneider et al. | 16/249 |
| 4,172,316 | 10/1979 | Rock et al. | 16/366 |

*Primary Examiner*—Werner H. Schroeder
*Assistant Examiner*—Andrew M. Falik
*Attorney, Agent, or Firm*—Wenderoth, Lind & Ponack

[57] ABSTRACT

A furniture hinge includes a mounting member that is fixable on a frame of a cabinet and a hinge casing that is insertable into a bore in a door. A hinge arm is linked to the hinge casing by means of hinge links. The hinge arm is mounted on the mounting member by means of an intermediate member and is held on this intermediate member by a screw. The position of the hinge arm is adjustable with respect to the mounting member.

5 Claims, 6 Drawing Figures

ADJUSTABLE FURNITURE HINGE

BACKGROUND OF THE INVENTION

1. Field of the Invention

This invention relates to a hinge for fastening a door to a frame of the body of a piece of furniture, comprising a hinge casing insertable into a bore of the door and linked to a hinge arm by means of a hinge axle or hinge axles and hinge links, such hinge arm being fastenable to a frame member by means of a mounting plate.

2. Description of the Prior Art

So-called door frames are widely used in modern furniture construction. Such frames, which are stable parts, carry the hinges for the door, and the actual side walls of the body of the piece of furniture are made of a weaker material. This novel kind of furniture construction creates new problems with respect to the mounting of the hinge, as the mounting plates of conventional hinges are too long to be fastened to the door frame. It is no longer possible to fasten the hinge to the furniture side wall as the side wall is, because of its weaker structure, not able to carry the load of the door wing.

SUMMARY OF THE INVENTION

It is, therefore, the object of this invention to provide a hinge which makes it possible to fasten the hinge arm to the frame of a door, i.e. the space required in the direction of the depth of the piece of furniture is reduced to the greatest possible extent, whereby an adjustment of the hinge arm is possible. The load of the door thereby is transferred to the frame member.

According to the invention, this is achieved by providing a hinge arm which is T-shaped in top view on the mounting plate and by aligning the mounting plate parallel to the hinge axle or hinge axles.

It is preferably provided that an intermediate member is arranged between the mounting plate and the hinge arm. The hinge arm is displaceable on the intermediate member in the direction of the breadth of the door joint and is fixable thereto by means of a clamping screw mounted in a female thread of the intermediate member and extending through a slot in the hinge arm.

A further embodiment of the invention provides that the clamping screw is aligned perpendicularly, i.e. orthogonally, to the hinge axles and parallel to the mounting plate.

The hinge arm is pushed onto the mounting plate from the side of the frame in a direction parallel to the closing plane of the door. Within a certain range, the hinge arm obviously can be secured in any position on the intermediate member by means of the clamping screw. Hence, an adjustment in the direction of the breadth of the door joint is possible.

An adjusting screw may preferably be provided which extends in the direction of the breadth of the door joint and abuts in the mounted position with its free end against the intermediate member or the mounting plate.

It is the main task of this adjusting screw to provide a zero position so that mounting operations can be easily carried out. Because of the zero position provided by the adjusting screw, which position is defined by the extent to which the adjusting screw projects from the hinge arm in the direction of the mounting plate, the hinge arm can, when the door is being mounted, be readily pushed onto the mounting plate or onto the intermediate member and fixed by means of the clamping screw. The position of the hinge arm in the direction of the breadth of the door joint is set by the stop of the adjusting screw. Only when an adjustment of the hinge arm is required and the hinge arm has to be further pushed onto the intermediate member or onto the mounting plate, need the adjusting screw to be turned.

BRIEF DESCRIPTION OF THE DRAWINGS

In the following, an embodiment of the invention will be described in more detail with reference to the accompanying drawings without being limited thereto, and in which.

DESCRIPTION OF THE PREFERRED EMBODIMENT

Figure 1:
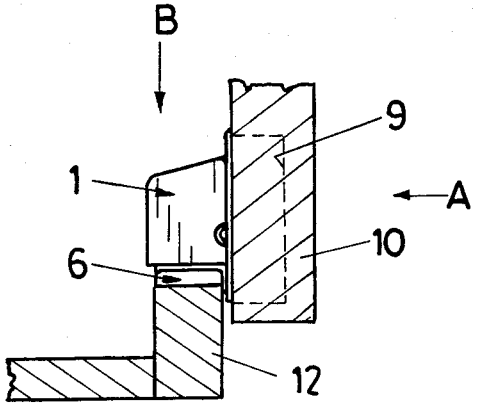
FIG. 1 is a side view of a hinge according to the invention in the closed position.
Figure 2:
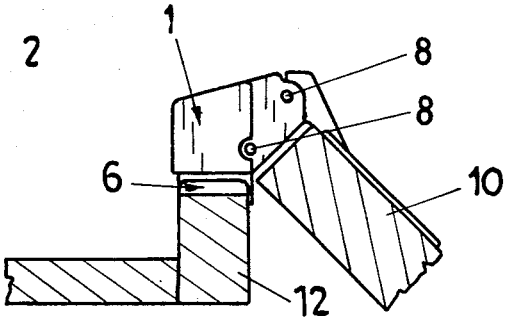
FIG. 2 is a view similar to FIG. 1, but in the open position.
Figure 3:
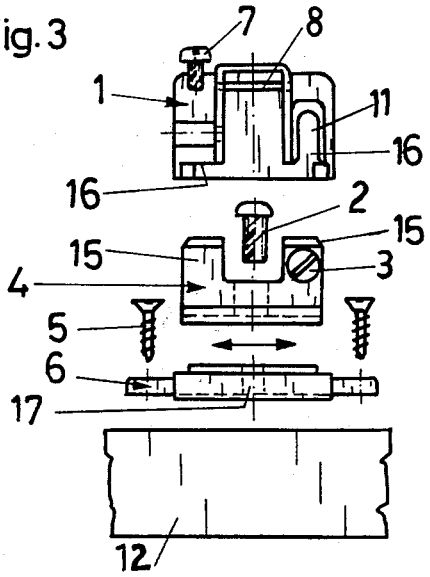
FIG. 3 is an exploded view of the hinge parts on the side of the frame, viewed from the direction of arrow A of FIG. 1.

The hinge according to the invention substantially comprises the following parts: a hinge casing 9 (only indicated in FIG. 1), which is insertable into a bore of a door 10, a hinge arm 1, which is linked to the hinge casing 9 by means of hinge links, an intermediate member 4, which is retained on a mounting plate 6 by means of a fastening screw 2, and the mounting plate 6.

The mounting plate 6 is laterally arranged on a frame member 12 and is fastened thereto by means of two screws 5. (Dowels may obviously also be employed).

In the view from the direction of arrow B of FIG. 1, the mounting plate 6 is of longitudinal configuration, and the hinge arm 1 is T-shaped.

From this direction, the hinge arm 1 is pushed onto the intermediate member 4, the intermediate member 4 having lateral flanges 15 extending into lateral grooves 16 of the hinge arm 1.

In the region of at least one groove 15, a clamping screw 3 is provided on the intermediate member 4.

The clamping screw 3 extends through a slot 11 in the hinge arm 1 and is perpendicularly aligned with respect of the hinge axles 8. The slot 11 is open towards the mounting plate 6.

When the hinge arm 1 has been pushed onto the intermediate member 4 and is in the desired position, the clamping screw 3 is fastened and, hence, hinge arm 1 is retained on the intermediate member 4.

The intermediate member 4 is fastened to the mounting plate 6 by means of a fastening screw 2 mounted in a female thread 17 of the mounting plate 6.

An adjusting screw 7 is provided in a lateral flange of the hinge arm 1, which is T-shaped in top view.

When the hinge arm 1 has been mounted, the adjusting screw 7 abuts with its front end against the intermediate member 4. Thereby, depending to which extent the adjusting screw 7 projects, a pre-set positioning of the hinge arm 1 with respect to the intermediate member 4 and, hence, with respect to the mounting plate 6 is provided.

In order to ensure a height adjustment of the hinge, it may be provided that the fastening screw 2 projects through a slot in the intermediate member 4, whereby the slot is aligned in the direction of the height of the piece of furniture.

Figure 4:
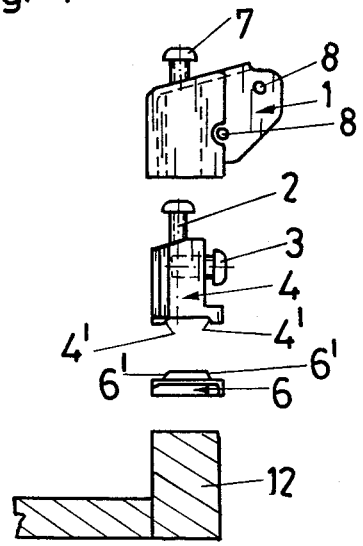
FIG. 4 is a view similar to FIG. 3, the parts being turned by 90°.
Figure 5:
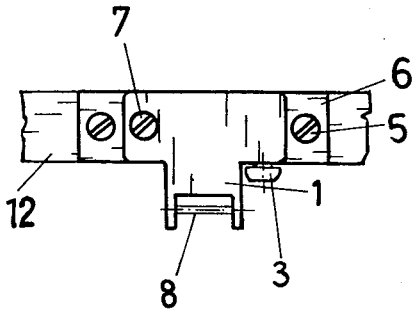
FIG. 5 is a view of the hinge parts on the side of the frame from the direction of arrow B of FIG. 1.
Figure 6:
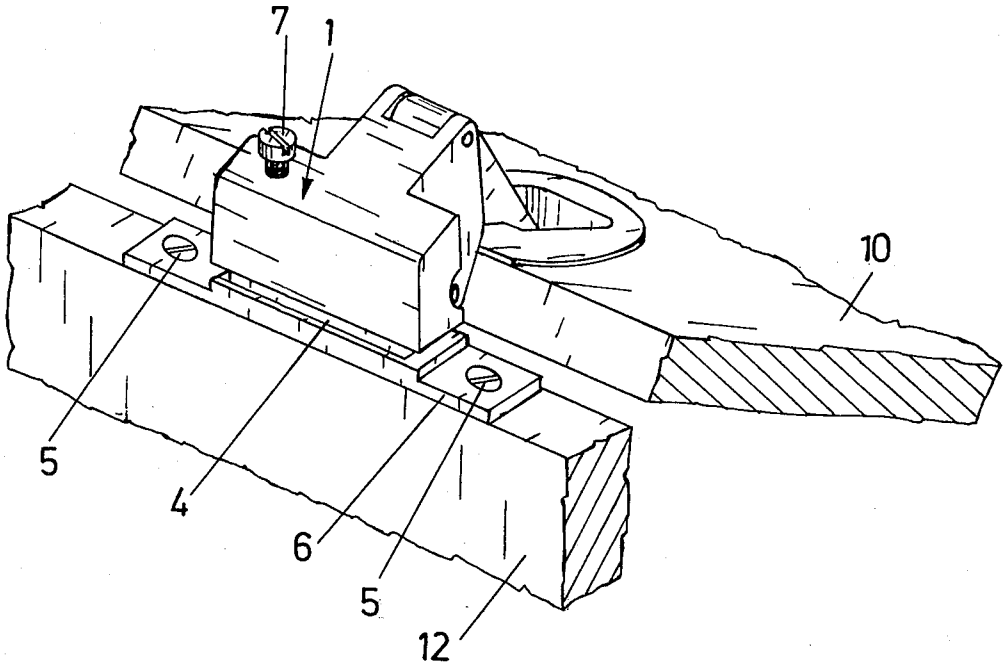
FIG. 6 is a perspective view of the hinge according to the invention.

Hence, the hinge arm 1 together with the intermediate member 4 is displaceable on the mounting plate 6 in the height of the piece of furniture. As the mounting plate 6 and the intermediate member 4 have rear and front guide faces 6', 4', as can be seen in FIG. 4, the hinge arm 1 is prevented from tilting under the load of the door 10. An alignment of the hinge arm 1 is already obtained, however, by disposing two hinges on each door 10.

What is claimed is:

1. A hinge for mounting a door on a frame of a body of an article of furniture, said hinge comprising:

a hinge casing adapted to be connected to a door;

a mounting plate adapted to be fixedly connected to a door frame;

a hinge arm connected to said hinge casing by means of at least one hinge axle, said hinge arm having a substantially T-shaped configuration as viewed in a direction facing said mounting plate; and means for mounting said hinge arm on said mounting plate, said mounting means including clamping screw means, extending orthogonal to said hinge axle and parallel to said mounting plate, for adjusting selectively the position of said hinge arm with respect to said mounting plate.

2. A hinge as claimed in claim 1, wherein said mounting means further includes an intermediate member arranged between said mounting plate and said hinge arm, said clamping screw means is threaded into said intermediate member, said hinge arm has therein a slot, and said hinge arm is displaceable on said intermediate member in the direction of the breadth of the door joint and is fixable thereto by means of said clamping screw means extending through said slot.

3. A hinge as claimed in claim 2, wherein said intermediate member is fixed to said mounting plate by means of a fastening screw.

4. A hinge as claimed in claim 2, wherein said hinge arm has therein lateral grooves, and said intermediate member has lateral flanges fitting into said lateral grooves.

5. A hinge as claimed in claim 2, further comprising an adjusting screw mounted in said hinge arm and extending in the direction of the door joint, said adjusting screw abutting against one of said mounting plate and said intermediate member.

* * * * *